US007422251B2

(12) United States Patent
Tanimoto et al.

(10) Patent No.: US 7,422,251 B2
(45) Date of Patent: Sep. 9, 2008

(54) DOOR HANDLE DEVICE

(75) Inventors: Tetsurou Tanimoto, Anjo (JP); Masaki Nishikawa, Kariya (JP); Yoshimasa Suzuki, Chita (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 179 days.

(21) Appl. No.: 11/197,652

(22) Filed: Aug. 5, 2005

(65) Prior Publication Data

US 2006/0028030 A1 Feb. 9, 2006

(30) Foreign Application Priority Data

Aug. 5, 2004 (JP) ..... 2004-229864

(51) Int. Cl.
*E05B 3/00* (2006.01)

(52) U.S. Cl. ..... 292/347; 292/DIG. 22; 292/DIG. 64

(58) Field of Classification Search ..... 292/336.3, 292/348, DIG. 53, DIG. 56, DIG. 64, DIG. 22
See application file for complete search history.

(56) References Cited

U.S. PATENT DOCUMENTS 4,580,821 A * 4/1986 Genord et al. ..... 292/336.3
4,653,143 A * 3/1987 Ketelhut et al. ..... 292/336.3
5,895,081 A * 4/1999 Tanimoto et al. ..... 292/348
6,167,779 B1 * 1/2001 Sano et al. ..... 74/543
6,998,752 B2 * 2/2006 Yasuhara et al. ..... 310/211

FOREIGN PATENT DOCUMENTS

DE 26 58 159 A1 7/1978
DE 29 01 202 A1 7/1980
JP 2000-291296 A 10/2000
JP 2001-32579 2/2001

OTHER PUBLICATIONS

European Search Report dated May 9, 2006.

* cited by examiner

*Primary Examiner*—Gary Estremsky
(74) *Attorney, Agent, or Firm*—Buchanan Ingersoll & Rooney PC

(57) ABSTRACT

A door handle device includes a handle member having a counterweight, a handle frame member configured to be fixed to a door and having an opening portion, the handle frame member being slidably engaged with the handle member while the counterweight being inserted through the opening portion. The door handle device further includes a first engaging shaft portion provided on the handle frame member, a second engaging shaft portion provided on the handle frame member, a first through hole provided on the handle member, a second through hole provided on the handle member, and an interposition member provided on a lower end contacting point between the handle member and the handle frame member after the handle member being slid relative to the handle frame member and engaged with the handle frame member at the smallest engaging angle therebetween.

17 Claims, 5 Drawing Sheets

DOOR HANDLE DEVICE

This application is based on and claims priority under 35 U.S.C. § 119 to Japanese Patent Application 2004-229864, filed on Aug. 5, 2004, the entire content of which is incorporated herein by reference.

FIELD OF THE INVENTION

This invention relates to a door handle device, and more particularly to an outside door handle device.

BACKGROUND

A known door handle device is described in JP2001-32579 A. The known door handle device includes a handle member and a handle frame member serving as a base. The handle frame member is fixed to a door while slidably engaging with the handle member. A pair of engaging portions is provided on the handle frame member and extends outwardly in a side direction. A pair of inserting grooves, into which the engaging portions are inserted, and a pair of shaft holes, with which the engaging portions are engaged, are provided on the handle member. The inserting grooves extend from the edge of the front side of the handle member inclined from a closed position to the backside thereof. The shaft holes are opened to the top end of the inserting grooves and the engaging portions are engaged with the shaft holes after being inserted into the inserting grooves. A cushion rubber is provided on each end of the handle frame member serving as an interposition member. Because handle member unlikely return to the closed position by means of the cushion rubbers, the engaging portions unlikely return from the shaft holes to the inserting grooves. Therefore, the handle member can easily be assembled to the handle frame member.

However, with the construction of the aforementioned door handle device, it is difficult to assemble the handle member to the handle frame member if the handle member with a counterweight is desired to be slidably engaged with the handle frame member while inserting the counterweight through the handle frame member.

When an opening portion is provided on the handle frame member and extended in a longitudinal direction longer than the handle member for accommodating other devices such as a key cylinder member in the handle frame member, the handle member should be engaged with the handle frame member in a condition where the counterweight is inserted through the opening portion. On this occasion, the counterweight may interfere with the handle frame member, thus the engaging portion unlikely be inserted into the inserting grooves which are extended from the edge of the front side of the handle member inclined from the closed position to the backside thereof. Accordingly, the handle member unlikely be engaged with the handle frame member when the handle frame member is extended in a longitudinal direction longer than the handle member, so as to allow the other devices such as the key cylinder member to be accommodated in the handle frame member.

A need thus exists for door handle device which is configured so as to accommodate the other devices such as the key cylinder member in the handle frame member and assemble, without difficulty, the handle member to the handle frame member.

SUMMARY OF THE INVENTION

According to an aspect of the present invention, a door handle device includes a handle member having a counterweight, a handle frame member configured to be fixed to a door and having an opening portion extended in a longitudinal direction longer than the handle member, the handle frame member being slidably engaged with the handle member while the counterweight being inserted through the opening portion. The door handle device further includes a first engaging shaft portion provided on the handle frame member and extended in a horizontal direction, a second engaging shaft portion provided on the handle frame member coaxially with the first engaging shaft portion and extended in a horizontal direction, a first through hole provided on the handle member for being engaged with the first engaging shaft portion, a second through hole provided on the handle member for being engaged with the second engaging shaft portion, and an interposition member provided on a lower end contacting point between the handle member and the handle frame member after the handle member being slid relative to the handle frame member and engaged with the handle frame member at the smallest engaging angle therebetween.

According to a further aspect of the present invention, a method for assembling a door handle device includes the steps of inserting a counterweight and an arm member of a handle member through a first opening portion of a handle frame member, making the handle member in contact with the handle frame member with the smallest engaging angle therebetween, inserting a first engaging shaft portion of the handle frame member into a first through hole of the handle member and inserting a second engaging shaft portion of the handle frame member into a second through hole of the handle member, sliding the handle frame member relative to the handle member, and engaging a stopper pin with a stopper hole in a condition where the handle member being engaged with the handle frame member with a predetermined engaging angle.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be explained with reference to illustrations of drawing figures as follows.

According to the handle device of the present invention, following members are prepared for assembling the handle device.

Figure 1:
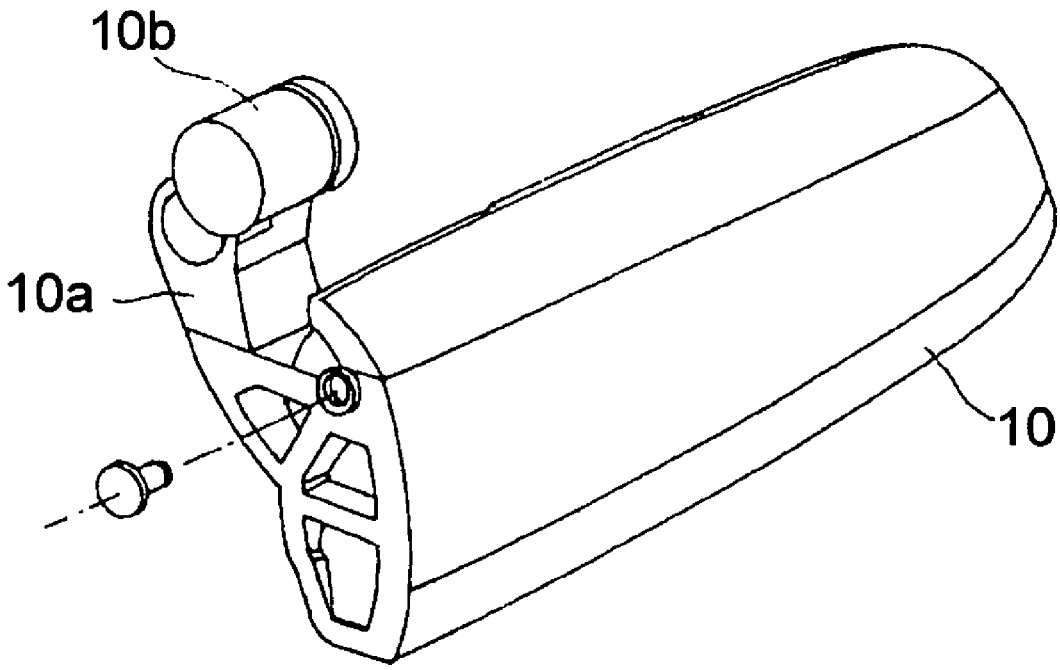
FIG. 1 is a perspective view of a handle member according to an embodiment of the present invention.

First, a handle member 10 serving as a pull-up type outside door handle is prepared as shown in FIG. 1. The handle member 10 includes an arm member 10*a* extending from the rear upper end of the backside (left side as viewed in FIG. 1) thereof and a counterweight 10*b* provided on the upper end of the arm member 10*a*. A wall member 10*c* is provided on the front portion of the backside of the handle member 10. A first through hole 11 is provided penetrated through the wall member 10*c* in a horizontal direction. The first through hole 11 includes a circular portion 11*a* and a recess portion 11*b* which is formed on the lower end of the circular portion 11*a*. Referring now particularly to the recess portion 11*b*, the recess portion 11*b* includes an entrance portion 111*b* serving as a first opening (shown in FIG. 2A) formed on the front portion of the wall member 10*c* and an exit portion 112*b* serving as a second opening (shown in FIG. 2B) formed on the rear portion of the wall member 10*c*. The entrance portion 111*b* includes a flat bottom and the exit portion 112*b* includes an arc shaped bottom. The length of the bottom of the exit portion 112*b* is longer than that of the entrance portion 111*b*. The exit portion 112*b* is stepwise wider than the entrance portion 111*b* so that a first engaging portion 21 rotates therein, so as to engage a projecting portion 21*b* of the first engaging portion 21 with the recess portion 11*b* of the first through hole 11 at the exit portion 112*b*. A second through hole 12 is positioned coaxially with the first through hole 11 and formed on the arm member 10*a*, which is positioned on the rear portion of the backside of the handle member 10, in a horizontal direction.

Figure 3:
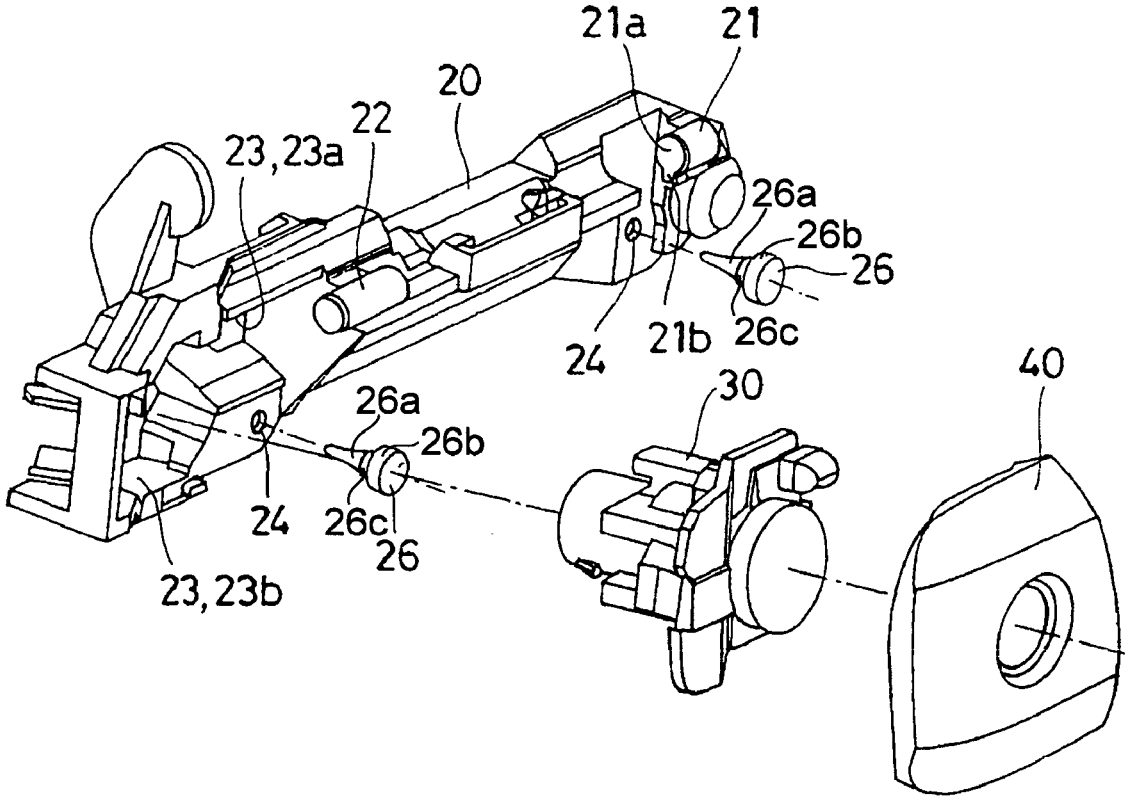
FIG. 3 is an exploded perspective view of the handle frame member according to the embodiment of the present invention.

Second, a handle frame member 20 made of resin or the like is prepared as shown in FIG. 3. The first engaging shaft portion 21 is provided laterally on the front end portion (right side as viewed in FIG. 3) of the handle frame member 20 and extended in a rear direction. The first engaging shaft portion 21 includes a circular portion 21*a* and the projecting portion 21*b* which is formed on the lower end of the circular portion 21*a*. The projecting portion 21*b* is approximately same size as the entrance portion 111*b* of the recess portion 11*b*. A second engaging shaft portion 22 is positioned coaxially with the first engaging shaft portion 21, provided laterally on the center portion of the handle frame member 20, and extended in a rear direction. An opening portion 23 is formed on the rear end of the handle frame member 20. The opening portion 23 includes a first opening portion 23*a* and a second opening portion 23*b* side by side. The arm member 10*a* and counterweight 10*b* of the handle member 10 are inserted through the first opening portion 23*a*. A door key cylinder 30 is inserted into the second opening portion 23*b*. The length of the handle frame member 20 in a longitudinal direction is longer than the handle member 10 (shown in FIG. 1) by the length of the second opening portion 23*b*. Referring to the handle frame member 20, stopper holes 24 are formed on the front portion of the front face of the handle frame member 20 and the lower level of the first opening portion 23*a*, respectively. The stopper holes 24 are provided as a lower end contacting point which is contactable with the handle member 10. A stopper pin 26 (i.e., an interposition member) made of rubber or the like is engageable with the stopper hole 24. The stopper pin 26 includes a pin portion 26*a* configured to be inserted into the inside of the handle frame member 20, a head portion 26*b* (i.e., a projecting portion) configured to be projected to the outside of the handle frame 20, and a stopper portion 26*c*, which is positioned between the pin portion 26*a* and the head portion 26*b*, configured to be engaged with the handle frame member 20. The pin portion 26*a* includes a cone shape, the head portion 26*b* includes a cylinder shape, and the stopper portion 26*c* includes a groove formed between the pin portion 26*a* and the head portion 26*b*.

A commercially available key cylinder member is prepared. The key cylinder member includes the door key cylinder 30 and a door key cylinder cover 40 having a keyhole of the door key cylinder 30.

The above-prepared members of the door handle device are assembled as follows.

Figure 4:
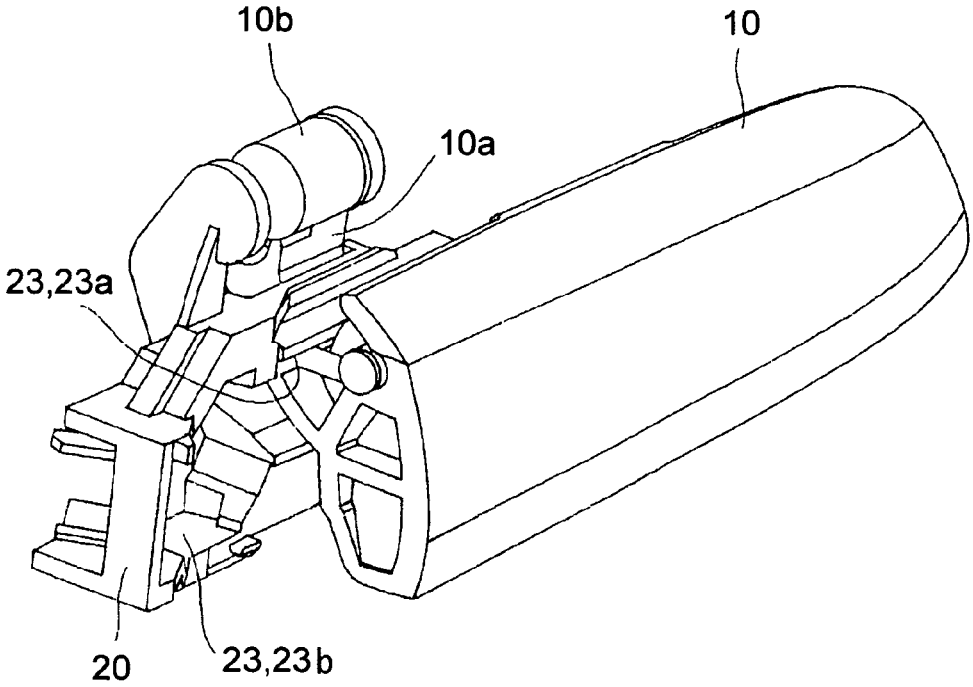
FIG. 4 is a perspective view of the handle member and the handle frame member of the handle device according to the embodiment of the present invention.

As shown in FIG. 4, the counterweight 10*b* and arm member 10*a* of the handle member 10 are inserted through the first opening portion 23*a* of the opening portion 23.

Figure 2A:
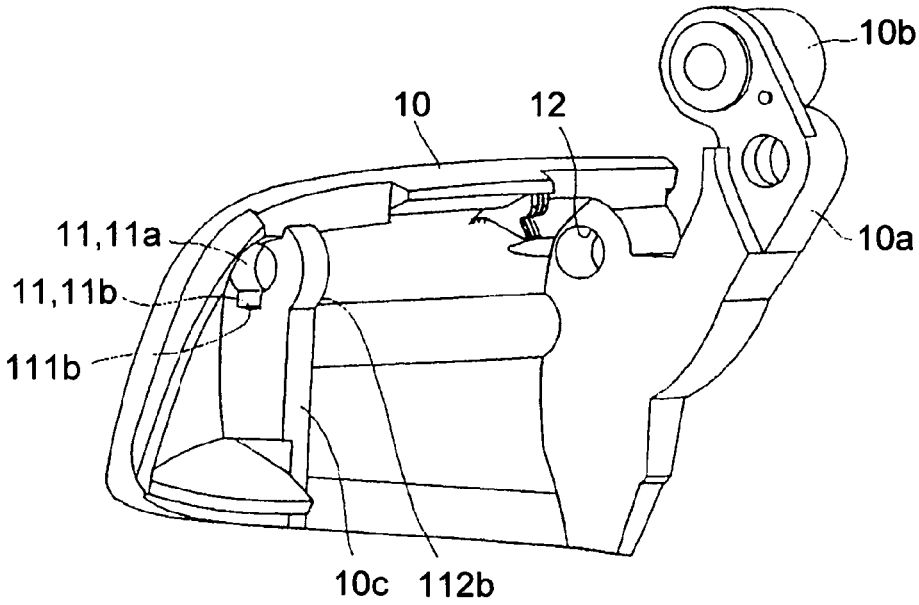
FIG. 2A is a front perspective view showing the backside of the handle member according to the embodiment of the invention.
Figure 2B:
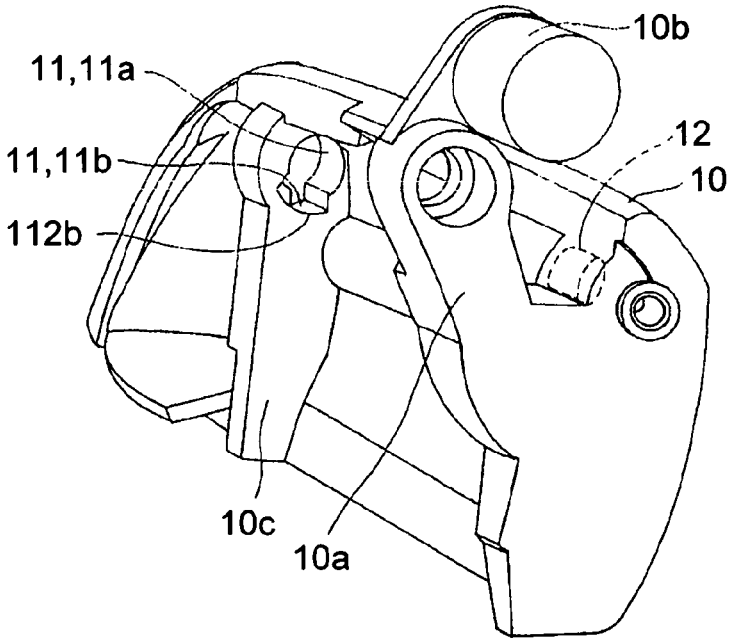
FIG. 2B is a rear perspective view showing the backside of the handle member according to the embodiment of the invention.

The handle member 10 is closely in contact with the handle frame member 20 with the smallest engaging angle therebetween, in other words, the backside of the handle member 10 (left side as viewed in FIG. 4) is made contact closely with the front face of the handle frame member 20 (right side as viewed in FIG. 1). As shown in FIGS. 1-3, the first engaging shaft portion 21 of the handle frame member 20 is inserted into the first through hole 11 of the handle member 10. The second engaging shaft portion 22 of the handle frame member 20 is inserted into the second through hole 12 of the handle member 10. On this occasion, the projecting portion 21*b* of the first engaging shaft portion 21 engages with the entrance portion 111*b* of the recess portion 11*b* of the first through hole 11 shown in FIG. 2A. As shown in FIG. 4, the handle frame member 20 is slid in a rear direction (left side as viewed in FIG. 4) relative to the handle member 10 in a condition where the projecting portion 21*b* of the first engaging shaft portion 21 is engaged with the entrance portion 111*b* of the recess portion 11*b* of the first through hole 11. Thus, the first engaging shaft portion 21 of the handle frame member 20 engages with the first through hole 11 of the handle member 10, and the second engaging shaft portion 22 of the handle frame member 20 engages with the second through hole 12 of the handle member 10.

Thereafter, the stopper pin 26 is engaged with the stopper hole 24 of the handle frame member 20 shown in FIG. 3, in a condition where the handle member 10 is engaged with the handle frame member 20 with a predetermined engaging angle.

The stopper pin 26 may be engaged with the handle member 10. In such a case, the stopper hole 24 is formed on the lower end contacting point of the handle member 10 which is contactable with the handle frame member 20.

Figure 5:
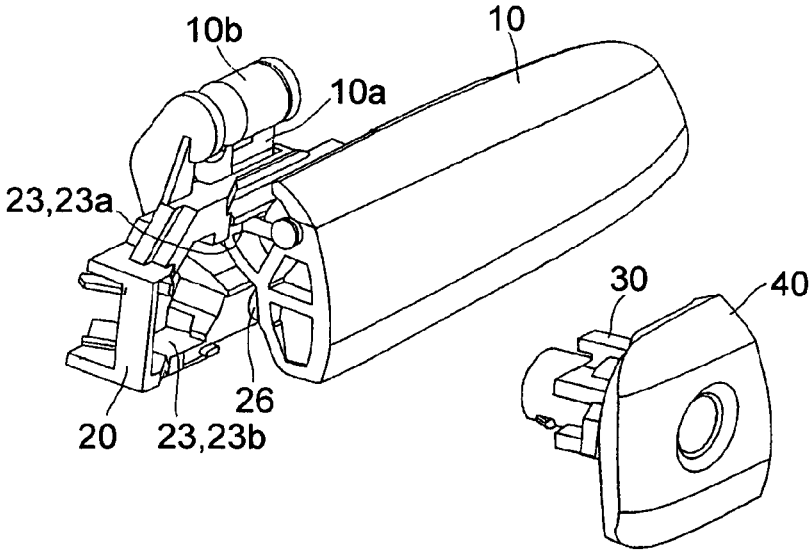
FIG. 5 is a perspective view of the door handle device according to the embodiment of the present invention.

By means of the stopper pin 26 being engaged with the lower end contacting point (stopper hole 24 shown in FIG. 3) of the handle frame member 20 which is contactable with the handle member 10, the engaging angle of the handle frame member 20 and the handle member 10 does not return to the smallest angle, as shown in FIG. 5. In such a condition, the projecting portion 21*b* of the first engaging shaft portion 21 is engaged with the recess portion 11*b* of the first through hole 11 at the exit portion 112*b*, as shown in FIGS. 1-3. Accordingly, the first engaging shaft portion 21 does not come off from the first through hole 11.

Figure 6:
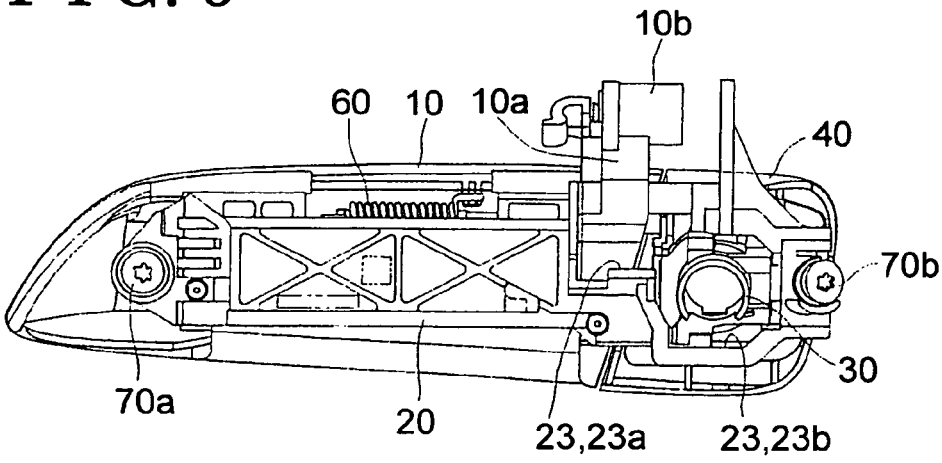
FIG. 6 is a front view of the backside of the door handle device according to the embodiment of the present invention.
Figure 7:
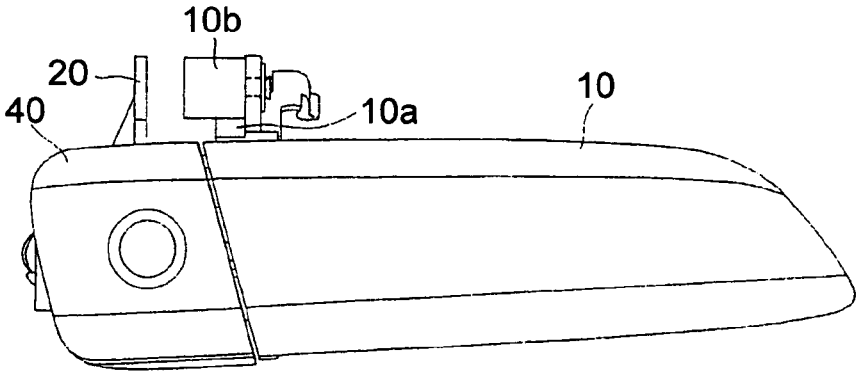
FIG. 7 is a front view of the front face of the door handle device according to the embodiment of the present invention.
Figure 8:
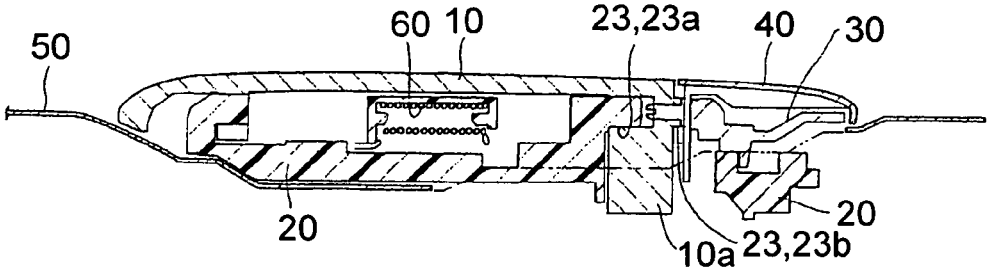
FIG. 8 is a cross sectional view of the door handle device assembled to a door according to the embodiment of the present invention.

As shown in FIG. 3, the door key cylinder cover 40 is fixed to a first end of the door key cylinder 30. As shown in FIG. 5, a second end of the door key cylinder 30 is inserted through the second opening portion 23*b* of the handle frame member 20 and fixed to the handle frame member 20. As shown in FIG. 6, a spring 60 is provided between the handle member 10 and the handle frame member 20 on the backside of the assembled door handle device for biasing the handle member to a closed position. The handle frame member 20 is fixed to a door 50 (shown in FIG. 8) by a fixing screw 70*a* positioned at the front end portion (left side as viewed in FIG. 6) of the handle frame member 20. The door key cylinder 30 and the door key cylinder cover 40 are coupled with the handle frame member 20 by a fixing screw 70*b* which is positioned at the rear end portion (right side as viewed in FIG. 6) of the handle frame member 20. The front face of the handle member 10 and the front face of the door key cylinder cover 40 are positioned on the same level at the front of the door handle device as shown in FIG. 7. Therefore, the handle device becomes superior in appearance. According to the door handle device of the present invention, the handle frame member 20 is fixed to the door 50 as shown in FIG. 8.

According to the door handle device assembled as mentioned above, the opening portion 23 is formed on the handle frame member 20 for accommodating the door key cylinder 30 in the handle frame member 20. The opening portion 23 extends in a longitudinal direction longer than the handle member 10. The counterweight 10*b* of the handle member 10 is inserted through the first opening portion 23*a* of the opening portion 23. The first engaging shaft portion 21 and the second engaging shaft portion 22 of the handle frame member 20 engage with the first through hole 11 and the second through hole 12 of the handle member 10, respectively. The handle member 10 can be engaged with the handle frame member 20 in a condition where the engaging angle of the handle member 10 and the handle frame member 20 becomes at the smallest angle by means of engagement between the projecting portion 21*b* of the first engaging shaft portion 21 and the recess portion 11*b* of the first through hole 11. The stopper pin 26 is provided at the lower end contacting point between the handle member 10 and the handle frame member 20 after the handle member 10 is engaged with the handle frame member 20. Because the engaging angle of the handle member 10 and the handle frame member 20 does not return to the smallest angle, the handle member 10 does not come off from the handle frame member 20. The stopper pin 26 also serves as a shock absorber, thus the shock between the handle member 10 and the handle frame member 20 can be reduced by means of the stopper pin 26. Accordingly, the handle member 10 is slidably engaged with the handle frame member 20 and the handle member 10 can easily be assembled to the handle frame member 20. With the assembled handle device, the door key cylinder 30 can be accommodated in the opening portion 23 (the second opening portion 23*b*) of the handle frame member 20 which is extended in a longitudinal direction relative to the handle member 10. The opening portion 23 is provided for accommodating the door key cylinder 30 in the handle frame member 20 and assembling the handle member 10, easily and firmly, to the handle frame member 20.

Accordingly, with the construction of the door handle device according to the embodiment of the present invention, the door key cylinder 30 can be accommodated in the handle frame member 20 and the handle member 10 can easily be assembled to the handle frame member 20.

According to the embodiment of the present invention, the opening portion is formed on the handle frame member for accommodating the key cylinder member in the handle frame member. The opening portion extends in a longitudinal direction longer than the handle member. The counterweight of the handle member is inserted through the opening portion. The first engaging shaft portion and the second engaging shaft portion of the handle frame member are engaged with the first through hole and the second through hole of the handle member, respectively. The handle member can be engaged with the handle frame member in a condition where the engaging angle of the handle member and the handle frame member becomes at the smallest angle. The interposition member is provided on the lower end contacting point between the handle member and the handle frame member after the handle member is engaged with the handle frame member. Thus, the engaging angle of the handle member and the handle frame member does not return to the smallest angle and the handle member does not come off from the handle frame member. With the construction of the handle device assembled as mentioned above, the other devices such as the key cylinder member can be accommodated in the opening portion of the handle frame member which is extended in a longitudinal direction relative to the handle member.

Accordingly, with the construction of the door handle device of the present invention, the other devices such as the key cylinder member can be assembled in the handle frame member and the handle member can easily be assembled to the handle frame member.

According to the embodiment of the present invention, the interposition member is provided on at least one of the handle member and the handle frame member. By means of the interposition member, the engaging angle of the handle member and the handle frame member does not return to the smallest angle. Accordingly, the handle member unlikely come off from the handle frame member by means of the interposition member. The interposition member can also reduce the shock between the assembled handle member and the handle frame member.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A door handle device comprising:

a handle member having a counterweight;

a handle frame member having an opening portion extended in a longitudinal direction longer than the handle member, the handle frame member being configured to be fixed to a door and being slidably engaged with the handle member while the counterweight is inserted through the opening portion;

a first engaging shaft portion provided on the handle frame member and extended in a horizontal direction;

a second engaging shaft portion provided on the handle frame member coaxially with the first engaging shaft portion and extended in a horizontal direction;

a first through hole provided on the handle member for being engaged with the first engaging shaft portion;

a second through hole provided on the handle member for being engaged with the second engaging shaft portion;

an interposition member provided on a lower end contacting point between the handle member and the handle frame member, the handle member being slidable relative to the handle frame member to engage the handle member with the handle frame member at a predetermined engaging angle therebetween;

wherein the first engaging shaft portion is provided on a first end portion of the handle frame member, the opening portion is formed on a second end portion of the handle frame member, and stopper holes are formed on one of the handle member or the handle frame member at a lower level of the first engaging shaft portion and the opening portion for being engaged with the interposition member; and wherein the handle member includes an arm member and a counterweight assembled to the arm member, the handle frame member is configured to be mounted with a key cylinder member, the handle frame member includes a first opening portion through which the arm member and the counterweight are inserted and a second opening portion into which the key cylinder member is inserted, and the opening portion includes the first and second opening portions.

2. The door handle device according to claim 1, wherein the interposition member is provided on at least one of the handle member and the handle frame member.

3. The door handle device according to claim 1, wherein the interposition member is made of rubber.

4. The door handle device according to claim 1, wherein the interposition member is engaged with the handle frame member.

5. The door handle device according to claim 1, wherein the interposition member includes a pin portion to be inserted into an inside of the handle frame member, a projecting portion to be projected from an outside of the handle frame, and a stopper portion positioned between the pin portion and the projecting portion to be engaged with the handle frame member.

6. The door handle device according to claim 5, wherein the pin portion includes a cone shape, the projecting portion includes a cylinder shape, and the stopper portion includes a groove formed between the pin portion and the projecting portion.

7. The door handle device according to claim 5, wherein the interposition member is made of rubber.

8. The door handle device according to claim 5, wherein the projecting portion of the interposition member is provided for preventing the handle member from being in contact with the handle frame member with a detachable, smallest, angle therebetween.

9. The door handle device according to claim 1, wherein the interposition member serves as a shock absorber between the handle frame member and the handle member.

10. The door handle device according to claim 1, wherein the stopper hole is formed on the lower level of the first opening portion.

11. The door handle device according to claim 1, wherein the handle frame member extends in a longitudinal direction longer than the handle member by the length of the second opening portion.

12. The door handle device according to claim 1, wherein the key cylinder member is assembled to the handle frame member after the handle member and the interposition member are assembled to the handle frame member.

13. The door handle device according to claim 1, wherein the first through hole includes a recess portion, the recess portion includes a first opening and a second opening, the first opening includes a flat bottom and the second opening includes an arc shaped bottom, and wherein length of the bottom of the second opening is longer than that of the first opening.

14. A method for assembling a door handle device, the method comprising:

inserting a counterweight and an arm member of a handle member through a first opening portion of a handle frame member;

making the handle member come into contact with the handle frame member with an angle therebetween;

inserting a first engaging shaft portion of the handle frame member into a first through hole of the handle member and inserting a second engaging shaft portion of the handle frame member into a second through hole of the handle member;

sliding the handle frame member relative to the handle member;

engaging a stopper pin with a stopper hole in a condition where the handle member is engaged with the handle frame member with a predetermined engaging angle fixing a door key cylinder cover to a first end of a door key cylinder;

inserting a second end of the door key cylinder through a second opening portion of the handle frame member;

fixing a key cylinder member to the handle frame member;

providing a spring between the handle member and the handle frame member; and fixing the door handle frame member to a door by a fixing screw.

15. The method for assembling a door handle device according to claim 14, wherein the first through hole and the second through hole are coaxial, and the first engaging shaft portion and the second engaging shaft portion are inserted into the first and second through holes respectively in a direction coaxial with respect to the first and second through holes.

16. A door handle device comprising:

a handle member having a counterweight;

a handle frame member having an opening portion extended in a longitudinal direction longer than the handle member, the handle frame member being configured to be fixed to a door and being slidably engaged with the handle member while the counterweight is inserted through the opening portion;

a first engaging shaft portion provided on the handle frame member and extended in a horizontal direction;

a second engaging shaft portion provided on the handle frame member coaxially with the first engaging shaft portion and extended in a horizontal direction;

a first through hole provided on the handle member for being engaged with the first engaging shaft portion;

a second through hole provided on the handle member for being engaged with the second engaging shaft portion;

an interposition member provided on a lower end contacting point between the handle member and the handle frame member, the handle member being slidable relative to the handle frame member to engage the handle member with the handle frame member at a predetermined engaging angle therebetween; and wherein the first engaging shaft portion and the second engaging shaft portion are arranged coaxially, a projecting portion projects from the first engaging shaft portion, the first through hole includes a recess portion, the recess portion including an entrance portion which the projecting portion enters as the frame member is moved coaxially relative to the first and second engaging shaft portions, the recess portion also including an exit portion from which the projecting portion exits as the frame member is moved coaxially relative to the first and second engaging shaft portions.

17. A door handle device comprising:

a handle member having a counterweight;

a first hole provided on the handle member;

a second hole provided on the handle member and arranged coaxial with the first through hole;

a handle frame member configured to be fixed to a door, the handle frame member having an opening portion extended in a longitudinal direction longer than the handle member;

the counterweight being insertable through the opening portion of the handle frame member, and the handle member and the handle frame member being relatively slidably movable after the counterweight is inserted through the opening portion of the handle frame member;

a first engaging shaft portion provided on the handle frame member, the first shaft engaging portion being provided with a projecting portion extending transverse to a direction of extent of the first shaft engaging portion;

a second engaging shaft portion provided on the handle frame member and arranged coaxially with the first engaging shaft portion;

the first and second engaging shaft portions being configured to be slidably inserted into the first and second holes respectively when the handle member and the handle frame member positioned at a first angle relative to one another are relatively slidably moved in a direction coaxial to the first and second engaging shaft portions after the counterweight is inserted through the opening portion of the handle frame member; and an interposition member configured to be positioned between the handle member and the handle frame member to position the handle member and the handle frame member at a second angle relative to one another greater than the first angle so that the projecting portion of the first shaft engaging portion is rotationally positioned to engage a portion of the first hole in a manner preventing the relative sliding movement of the handle member and the handle frame member in the direction coaxial to the first and second engaging shaft portions.

* * * * *